US011627794B2

(12) United States Patent
Thiebaut et al.

(10) Patent No.: US 11,627,794 B2
(45) Date of Patent: Apr. 18, 2023

(54) APPARATUS AND METHOD TO REALIZE PERSONALIZED COSMETIC COMPOSITIONS

(71) Applicant: L'OREAL, Paris (FR)

(72) Inventors: Geraldine Thiebaut, Neuilly-sur-Seine (FR); Guive Balooch, New York, NY (US); Helga Malaprade, Vincennes (FR)

(73) Assignee: L'OREAL, Paris (FR)

( * ) Notice: Subject to any disclaimer, the term of this patent is extended or adjusted under 35 U.S.C. 154(b) by 1062 days.

(21) Appl. No.: 16/236,774

(22) Filed: Dec. 31, 2018

(65) Prior Publication Data

US 2019/0200733 A1 Jul. 4, 2019

Related U.S. Application Data

(60) Provisional application No. 62/611,808, filed on Dec. 29, 2017.

(51) Int. Cl.
*B01F 25/433* (2022.01)
*G07F 13/06* (2006.01)
(Continued)

(52) U.S. Cl.
CPC ..... *A45D 44/005* (2013.01); *B01F 25/4331* (2022.01); *B01F 31/65* (2022.01);
(Continued)

(58) Field of Classification Search
CPC ..... G07F 11/70; G07F 13/06; G07F 13/10; A45D 44/005; B01F 2101/21; B01F 31/65
See application file for complete search history.

(56) References Cited

U.S. PATENT DOCUMENTS 9,114,087 B2 * 8/2015 Wei ..... A61K 8/03
9,138,041 B2 * 9/2015 Samain ..... G16H 20/13
(Continued)

FOREIGN PATENT DOCUMENTS

CN 1338972 A 3/2002
CN 103328171 A 9/2013
(Continued)

OTHER PUBLICATIONS

Translation of DE 20 2008 001224 (Year: 2008).*
(Continued)

*Primary Examiner* — Jason K Niesz
(74) *Attorney, Agent, or Firm* — Oblon, McClelland, Maier & Neustadt, L.L.P.

(57) ABSTRACT

An apparatus to realize personalized cosmetic compositions including a formula supply assembly having a plurality of additive reservoirs that contains a plurality of additive substances, a plurality of additive pumps that supplies selected additive quantities of the plurality of additive substances, a base reservoir that contains a base substance, and a base pump that supplies a base quantity of the base substance and a mixing assembly having an additive inlet that receives the selected additive quantities, a base inlet that receives the base quantity, and a mixing channel that mixes the additive quantities with the base quantity to form the personalized cosmetic compositions.

12 Claims, 5 Drawing Sheets
(2 of 5 Drawing Sheet(s) Filed in Color)

(51) Int. Cl.

| | |
|---|---|
| ***A45D 44/00*** | (2006.01) |
| ***B01F 31/65*** | (2022.01) |
| ***B01F 33/84*** | (2022.01) |
| ***B01F 35/10*** | (2022.01) |
| ***B01F 35/71*** | (2022.01) |
| ***G07F 11/70*** | (2006.01) |
| ***G07F 13/10*** | (2006.01) |
| *B01F 101/21* | (2022.01) |

(52) U.S. Cl.
CPC ..... *B01F 33/8442* (2022.01); *B01F 35/1452* (2022.01); *B01F 35/71755* (2022.01); *G07F 11/70* (2013.01); *G07F 13/06* (2013.01); *G07F 13/10* (2013.01); *B01F 2101/21* (2022.01)

(56) References Cited

U.S. PATENT DOCUMENTS

| | | | | |
|---|---|---|---|---|
| 2005/0165705 | A1* | 7/2005 | Lauper | G06Q 99/00 705/500 |
| 2006/0219307 | A1 | 10/2006 | Wang et al. | |
| 2012/0307589 | A1* | 12/2012 | Hanada | B01F 23/45 366/339 |
| 2017/0158362 | A1 | 6/2017 | Rodrigues | |
| 2017/0228892 | A1 | 8/2017 | Nichol et al. | |
| 2018/0033161 | A1 | 2/2018 | Nichol et al. | |
| 2018/0125206 | A1* | 5/2018 | Shami | B05C 11/1036 |
| 2019/0080480 | A1 | 3/2019 | Nichol et al. | |

FOREIGN PATENT DOCUMENTS

| | | | |
|---|---|---|---|
| CN | 105142798 | A | 12/2015 |
| DE | 20 2008 001 224 | U1 | 5/2006 |
| DE | 10 2006 049 054 | A1 | 4/2008 |
| DE | 20 2008 001 224 | U1 | 5/2008 |
| DE | 10 2014 017 032 | A1 | 5/2016 |
| JP | 11-147811 | A | 6/1999 |
| JP | 2009-106864 | A | 5/2009 |
| JP | 2015-531272 | A | 11/2015 |
| JP | 2016-026183 | A | 2/2016 |
| WO | WO 2008/046519 | A1 | 4/2008 |
| WO | WO 2012/098502 | A1 | 7/2012 |

OTHER PUBLICATIONS

Combined Chinese Office Action and Search Report dated Oct. 26, 2021 in corresponding Chinese Patent Application No. 201880090480.1 (with English Translation of Category of Cited Documents), 10 pages.

Japanese Office Action dated Mar. 22, 2022 in Japanese Patent Application No. 2020-536650, 3 pages.

European Office Action dated Mar. 24, 2022 in European Patent Application No. 18 834 295.0, 6 pages.

Communication pursuant to Rules 161(1) and 162 EPC dated Aug. 5, 2020 in corresponding European Patent Application No. 18834295.0, 3 pages.

Office Action dated Aug. 24, 2021 in corresponding Japanese Patent Application No. 2020-536650, 7 pages.

International Search Report and Written Opinion dated Apr. 16, 2019 in PCT/US2018/067718, 21 pages.

Korean Office Action dated Nov. 25, 2021 in Korean Patent Application No. 10-2020-7021746 (with English translation), 18 pages.

Office Action dated May 2, 2022, in corresponding Korean Patent Application No. 10-2020-7021746 (with English Translation), 11 pages.

Korean Office Action dated Nov. 3, 2022, issued in Korean Patent Application No. 10-2020-7021746 (with English translation).

* cited by examiner

APPARATUS AND METHOD TO REALIZE PERSONALIZED COSMETIC COMPOSITIONS

CROSS-REFERENCE TO RELATED APPLICATIONS

This application claims the benefit of priority from U.S. Application No. 62/611,808 filed Dec. 29, 2017, the entire contents of which are incorporated herein by reference.

BACKGROUND

Field of the Disclosure

The present disclosure relates to realizing personalized cosmetic compositions.

Description of the Related Art

Today, cosmetics and beauty products are facing an extremely diversified and demanding consumer market. Cosmetics need to address extremely specific and diversified demands from consumers. Consumers are looking for cosmetics with specific properties that correspond to personal demands and tastes such as certain active ingredients and/or colors.

Further, throughout the day, the week, and/or the month one single consumer may have different demands and/or requirements that may correspond to different situations, dress codes and/or time periods, e.g. work, after-work outgoings, cloth matching, and/or evening entertainment.

Carrying, storing, and/or owning a multitude of cosmetic products in a multitude of variations to address the multitude of demands that may occur throughout time can be cumbersome or even not feasible.

Thus, an apparatus and method to realize personalized cosmetic compositions which can address the specific and diversified demands from clients while being compact and portable is desired.

SUMMARY

Accordingly, one object of the present disclosure is to provide an apparatus and a method to realize personalized cosmetic compositions to address the diversified and peculiar demands of the consumers while being compact and portable. The apparatus of the present disclosure addresses such a need by relying on microfluidic systems that select, supply, transport, and mix different ingredients to provide personalized cosmetic compositions.

In one non-limiting illustrative example, an apparatus to realize personalized cosmetic compositions is presented. The apparatus to realize personalized cosmetic compositions includes a formula supply assembly having a plurality of additive reservoirs that contains a plurality of additive substances, a plurality of additive pumps that supplies selected additive quantities of the plurality of additive substances, a flush reservoir that contains a flush substance, and a flush pump that supplies a flush quantity of the flush substance, a mixing assembly having an additive inlet that receives the selected additive quantities and the flush quantity, an outlet that delivers the personalized cosmetic compositions, and a mixing channel that channels the selected additive quantities from the additive inlet to the outlet, and an electronic control unit configured to acquire a desired formulation from a consumer, determine the selected additive quantities based on the desired formulation, operate the plurality of additive pumps to provide the selected additive quantities to the additive inlet, and operate the flush pump to push the selected additive quantities along the mixing channel to provide mixing between the additive quantities and form the personalized cosmetic compositions.

In another non-limiting illustrative example, an apparatus to realize personalized cosmetic compositions is presented. The apparatus to realize personalized cosmetic compositions includes a formula supply assembly having a plurality of additive reservoirs that contains a plurality of additive substances, a plurality of additive pumps that supplies selected additive quantities of the plurality of additive substances, a base reservoir that contains a base substance, and a base pump that supplies a base quantity of the base substance, a mixing assembly having an additive inlet that receives the selected additive quantities, a base inlet that receives the base quantity, an outlet that delivers the personalized cosmetic compositions, and a mixing channel that channels the selected additive quantities and the base quantity from the additive inlet and the base inlet to the outlet, and an electronic control unit configured to acquire a desired formulation from a consumer, determine the selected additive quantities based on the desired formulation, and operate the plurality of additive pumps and the base pump to push the selected additive quantities and the base quantity along the mixing channel to provide mixing between the additive quantities and the base quantity to form the personalized cosmetic compositions.

In another non-limiting illustrative example, an apparatus to realize personalized cosmetic compositions is presented. The apparatus to realize personalized cosmetic compositions includes a formula supply assembly having a plurality of additive reservoirs that contains a plurality of additive substances, a plurality of additive pumps that supplies selected additive quantities of the plurality of additive substances, a base reservoir that contains a base substance, and a base pump that supplies a base quantity of the base substance, and a dispensing assembly having an additive inlet that receives the selected additive quantities, a base inlet that receives the base quantity, and a channel that merges the additive quantities with the base quantity to dispense the personalized cosmetic compositions.

BRIEF DESCRIPTION OF THE SEVERAL VIEWS OF THE DRAWINGS

The patent or application file contains at least one drawing executed in color. Copies of this patent or patent application publication with color drawing(s) will be provided by the Office upon request and payment of the necessary fee. A more complete appreciation of the embodiments and many of the attendant advantages thereof will be readily obtained as the same becomes better understood by reference to the following detailed description when considered in connection with the accompanying drawings, wherein.

DETAILED DESCRIPTION

Figure 1:
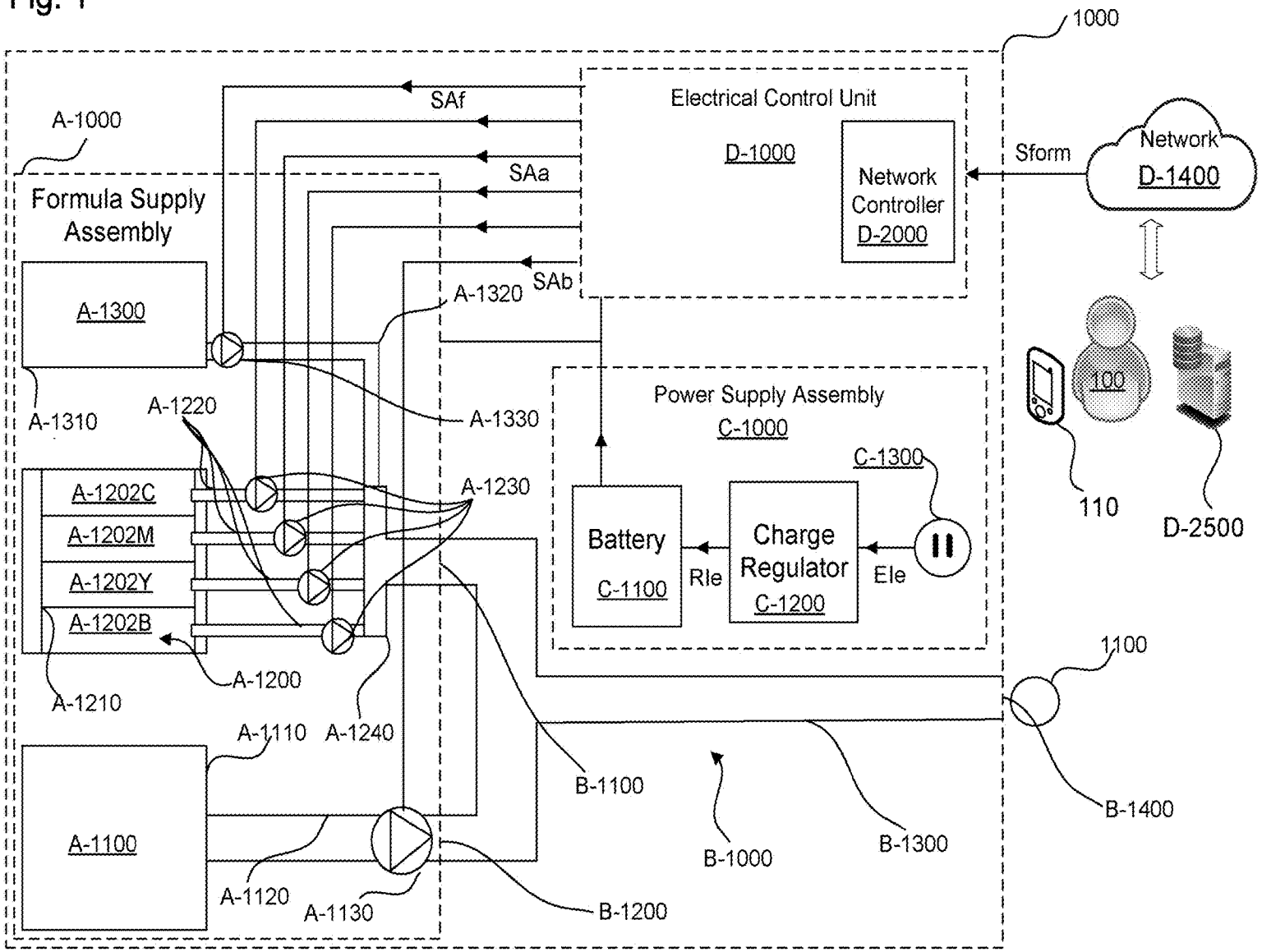
FIG. 1 is a schematic view of an apparatus to realize personalized cosmetic compositions, according to certain aspects of the disclosure.

All publications, patent applications, patents, and other references mentioned herein are incorporated by reference in their entirety. Further, the materials, methods, and examples discussed herein are illustrative only and are not intended to be limiting.

In the drawings, like reference numerals designate identical or corresponding parts throughout the several views. Further, as used herein, the words "a", "an", and the like include a meaning of "one or more", unless stated otherwise. The drawings are generally drawn not to scale unless specified otherwise or illustrating schematic structures or flowcharts.

FIG. 1 is a schematic view of an apparatus 1000 to realize personalized cosmetic compositions 1100, according to certain aspects of the disclosure.

The apparatus 1000 presented provides to a consumer 100 the ability to select and incorporate his or her own ingredients in order to create and deliver personalized cosmetic compositions 1100, e.g. liquid lipsticks and/or nail polishes, with selected formulae and/or colors, that correspond to the specific and current need of the consumer 100. In addition, the apparatus 1000 presented can provide a small and compact packaging that can be easily transported by the consumer 100, e.g. placed in a pocket and/or handbag.

The apparatus 1000 can include a formula supply assembly A-1000, a mixing assembly B-1000 fluidly connected to the formula supply assembly A-1000, an electronic control unit D-1000 operatively coupled to the formula supply assembly A-1000 and/or the mixing assembly B-1000, and a power supply assembly C-1000 that provides power to the electronic control unit D-1000 and the formula supply assembly A-1000.

The formula supply assembly A-1000 can supply a base substance A-1100 and a plurality of additive substances A-1200 to the mixing assembly B-1000 while the mixing assembly can receive, convey, and mix the base substance A-1100 and the plurality of additive substances A-1200 to provide the personalized cosmetic compositions 1100.

In addition, the formula supply assembly A-1000 can supply to the mixing assembly B-1000 with a flushing substance A-1300, to purge and clean the mixing assembly B-1000 from residues left by the base substance A-1100 and/or the plurality of additive substances A-1200.

The formula supply assembly A-1000 can include a base reservoir A-1110 that contains the base substance A-1100, a base channel A-1120 that fluidly connects the base reservoir A-1110 to the mixing assembly B-1000, a base pump A-1130 positioned on the base channel A-1120 between the base reservoir A-1110 and the mixing assembly B-1000, a plurality of additive reservoirs A-1210 that contains the plurality of additive substances A-1200, a plurality of additive channels A-1220 that fluidly connects the plurality of additive reservoirs A-1210 to the mixing assembly B-1000, a plurality of additive pumps A-1230 positioned on the plurality of additive channels A-1220 between the plurality of additive reservoirs A-1210 and the mixing assembly B-1000, an additive manifold A-1240 positioned between the plurality of additive pumps A-1230 and the mixing assembly B-1000 that merges together the plurality of additive substances A-1200, a flushing reservoir A-1310 that contains the flushing substance A-1300, and a flushing channel A-1320 that fluidly connects the flushing reservoir A-1310 with the plurality of additive channels A-1220, the base channel A-1120, and/or the mixing assembly B-1000.

The base substance A-1100 may include fillers that can be mixed with the plurality of additive substances A-1200 and/or colored by the plurality of additive substances A-1200. For example, the base substance A-1100 may be a white liquid containing talc, stearic acid or/and silicon.

The plurality of additive substances A-1200 may include a plurality of compounds with specific chemical and/or physical characteristics to enhance in a personalized way the appearance and/or scent of the consumer 100. The plurality of additive substances A-1200 can include a plurality of liquid binders each containing a different pigment, fragrant essential oils with different scents, different beneficial ingredients, e.g. different serums and/or skin care active ingredients.

For example, the plurality of liquid binders can include a cyan binder A-1202C with a cyan pigment, a magenta binder A-1202M with a magenta pigment, a yellow binder A-1202Y with a yellow pigment, and a black binder A-1202B with a black pigment.

In addition, each additive reservoir of the plurality of additive reservoirs A-1210 can be configured to be removed and replaced similarly to cartridges and contains an additive volume sufficiently important to supply the mixing assembly B-1000 with the plurality of additive substances A-1200 for an utilization lasting between 1 day and 1 year, and preferably between 1 week and 6 months. For example, the additive volume can be between 0.1 mL and 10 mL, and preferably between 0.5 mL and 1.5 mL.

The selection of the plurality of additive substances A-1200 to be mixed with the base substance A-1100 may be chosen as a function of personal preferences of the consumer 100, such as color/tone, and/or texture. For example, by selecting an appropriate proportion of the cyan binder A-1202C, magenta binder A-1202M, yellow binder A-1202Y, and the black binder A-1202B the personalized cosmetic composition 1100 may be created to match a color selected by the consumer 100.

The selection of the plurality of additive substances A-1200 to be mixed with the base substance A-1100 may be selected manually via the consumer 100, automatically via software instruction executed by the electronic control unit D-1000 or the combination thereof.

Alternatively, the plurality of additive substances A-1200 can include a plurality of cosmetic substances, having each different characteristics, e.g. color, tone, sheen, and/or texture, that can be mixed between each other with or without the base substance A-1100 by the mixing assembly B-1000 to provide the personalized cosmetic compositions 1100. For example, the plurality of additive substances A-1200 can include a plurality of lipsticks with different base colors, e.g. red, brown, pink, orange, beige, and/or white, that can be mixed together to provide the personalized cosmetic compositions 1100 with a personalized color.

The flushing substance A-1300 can be any liquid capable of purging and/or cleaning the mixing assembly B-1000 from residues left by the base substance A-1100 and/or the plurality of additive substances A-1200. For example the flushing substance can be a transparent or white base formula and can include water, alcohol, oils, and/or detergent.

The plurality of additive pumps A-1230, the base pump A-1130, and the flush pump A-1330 can be any pump that provide sufficiently high flow rates and low energy consumption to allow adequate usage by the consumer 100, wherein the adequate usage can correspond to deliver a predetermined dose Qc of the personalized cosmetic compositions 1100 between 1 μL and 500 μL and preferably between 20 μL and 300 μL, in a duration between 1 s and 5 s, at frequency of less than 10 times a day during at least a week without having to recharge the power supply assembly C-1000.

For example, the plurality of additive pumps A-1230, the base pump A-1130, and the flush pump A-1330 can be peristatic pumps and/or piezoelectric pumps such as the Peristatic Pump 3200243 and/or the Piezoelectric Pump 3200138 from Dolomite Microfluidics®.

The electronic control unit D-1000 can acquire desired formulations for the personalized cosmetic compositions 1100 and operate the formula supply assembly A-1000 to provide a plurality of selected additive quantities Qa based on the desired formulation and a predetermined base quantity Qb to the mixing assembly B-1000 that composed and deliver the predetermined dose Qc of the personalized cosmetic composition 1100.

For example, the electronic control unit D-1000 can be configured to receive formulation signals Sform commensurate with the desired formulations for the personalized cosmetic compositions 1100, send a plurality of additive actuation signals SAa to the plurality of additive pumps A-1230, and base actuation signals SAb to the base pump A-1130, wherein the plurality of additive actuation signals SAa is commensurate with the plurality of selected additive quantities Qa and the base actuation signals SAb are commensurate with the predetermined base quantity Qb. In addition, the electronic control unit D-1000 can be further configured to send actuation signals SAf commensurate with a flush quantity to the flush pump A-1330 and provide purging and/or cleaning of the apparatus 1000.

The formulation signals Sform can be send from an electronic device 110 of the consumer 100 and/or a database D-2500 to the electronic control unit D-1000 through a network D-1400 and a network controller D-2000 of the apparatus 1000.

For example, the network controller D-2000 can be as an Intel Ethernet PRO® network interface card from Intel Corporation of America®, for interfacing with the network D-1400. As can be appreciated, the network D-1400 can be a public network, such as the Internet, or a private network such as an LAN or WAN network, or any combination thereof and can also include PSTN or ISDN sub-networks. The network D-1400 can also be wired, such as an Ethernet network, or can be wireless such as a cellular network including EDGE, 3G and 4G wireless cellular systems. The wireless network can also be WiFi, Bluetooth, or any other wireless form of communication that is known.

The database D-2500 can be an electronic database, a computer and/or computerized server, database server, e-commerce server or any network host configured to store data.

The different elements of the electronic control unit D-1000 as well as their interactions and functionality will be described in further detailed in the following paragraphs.

The power supply assembly C-1000 can supply power, e.g. electrical voltages, to the electronic control unit D-1000 and the formula supply assembly A-1000.

The power supply assembly C-1000 can include an electrical charge connector C-1300, a battery C-1100 electrically connecting the battery C-1100 to the plurality of additive pumps A-1230, the base pump A-1130, the flush pump A-1330, and the electronic control unit D-1000, and a charge regulator C-1200 electrically connecting the battery C-1100 to the electrical charge connector C-1300.

The electrical charge connector C-1300 can be any sort of electrical connectors, e.g. USB connector, type A receptacle, type B plug, or the like, that can be connected to an external power source, e.g. external battery, electrical grid, or the like, to provide external input electricity EIe.

The charge regulator C-1200 can receive, rectify, and regulate the external input electricity EIe from the external power source to provide regulated input electricity RIe to the battery C-1100. The charge regulator C-1200 can prevent transferring over voltages to the battery C-1100 to enhance battery performance and lifespan.

The charge regulator C-1200 can be a stand-alone device, as illustrated in FIG. 1, or circuitry integrated to the battery C-1100. To provide the regulated output electricity RIe, the charge regulator C-1200 can rely on Pulse Width Modulation (PWM) and/or Maximum Power Point-Tracker (MPPT) technologies.

The battery C-1100 can store the regulated output electricity RIe to be used concurrently or subsequently in elements of the apparatus 1000, e.g. the base pump A-1130, the plurality of additive pumps A-1230, the flush pump A-1330, and/or the electronic control unit D-1000. The battery C-1100 can be a single or a plurality of alkaline batteries, lead acid batteries, lithium-ion batteries, or the like, and have a battery capacity sufficiently high to allow the apparatus 1000 to be used several times, e.g. between 20 and 100 times, without having to recharge the battery C-1100.

Figure 2A:
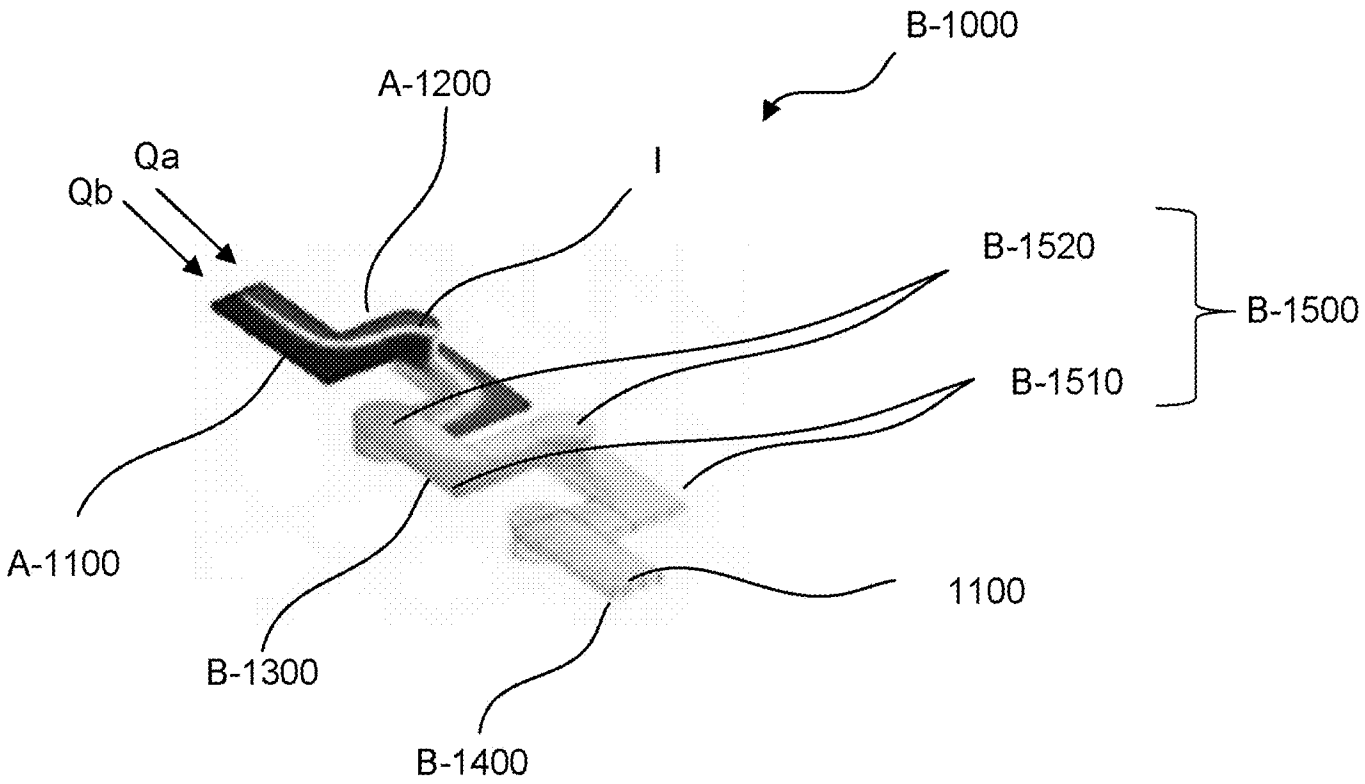
FIG. 2A is a schematic view of a mixing assembly of the apparatus to realize personalized cosmetic compositions with a passive configuration, according to certain aspects of the disclosure.
Figure 2B:
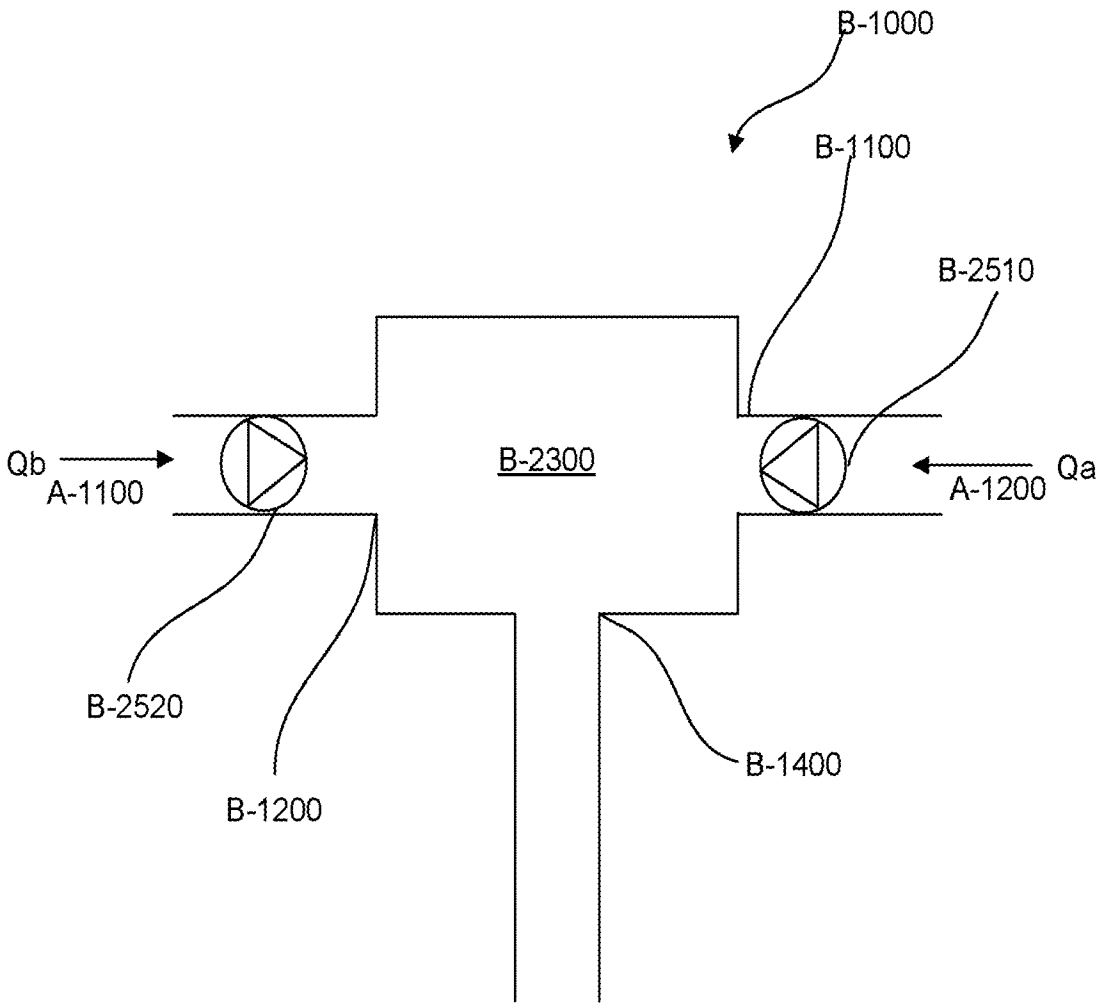
FIG. 2B is a schematic view of the mixing assembly of the apparatus to realize personalized cosmetic compositions with an active configuration, according to certain aspects of the disclosure.

FIGS. 2A-2B are schematic views of the mixing assembly B-1000 of the apparatus 1000 to realize the personalized cosmetic compositions 1100 in a passive configuration and in an active configuration, according to certain aspects of the disclosure.

The mixing assembly B-1000 can include an additive inlet B-1100 fluidly connected to the plurality of additive channels A-1220 via the additive manifold A-1240, a base inlet B-1200 fluidly connected to the base channel A-1120, an outlet B-1400, and a mixing channel B-1300 extending between the additive inlet B-1100, the base inlet B-1200 and the outlet B-1400.

The additive inlet B-1100 can receive the plurality of additive substances A-1200, the base inlet B-1200 can receive the base substance A-1100, while the mixing channel B-1300 can mix the plurality of additive substances A-1200 into the base substance A-1100 as the plurality of additive substances A-1200 and the base substance A-1100 flow along a length of the mixing channel B-1300.

The mixing assembly B-1000 can have a passive configuration to mix the plurality of additive substances A-1200 and the base substance A-1100, as illustrated in FIG. 2A. For example in the passive configuration, the mixing channel B-1300 can include a plurality of geometrical perturbations B-1500 that forces the flow of the plurality of additive substances A-1200 and the base substance A-1100 to repeatedly change of direction as the plurality of additive substances A-1200 and the base substance A-1100 flow along the mixing channel B-1300.

The plurality of geometrical perturbations B-1500 are configured to extend an interface I between the plurality of additive substances A-1200 and the base substance A-1100 by successive motions of stretching and folding as the plurality of additive substances A-1200 and the base substance A-1100 flows along the mixing channel B-1300.

For example, the plurality of geometrical perturbations B-1500 can include a plurality of elbows B-1510 that changes the direction of the flow from a longitudinal direction to a lateral direction, or vice-versa, as illustrated in FIG. 2A.

In another example, the plurality of geometrical perturbations B-1500 can include a plurality of cross sectional extensions B-1520 that change the cross section of the mixing channel B-1300 from a rectangular cross section to a circular cross section, or vice-versa, as illustrated in FIG. 2A.

In another example, the plurality of geometrical perturbations B-1500 can include ridges, grooves, protrusions, tongues, channel crossing, channel braiding that increase the interface I between the plurality of additive substances A-1200 and the base substance A-1100 as the plurality of additive substances A-1200 and the base substance A-1100 flows along the mixing channel B-1300.

Alternatively, the mixing channel B-1300 can have an active configuration to mix the plurality of additive substances A-1200 and the base substance A-1100, as illustrated in FIG. 2B. For example in the active configuration, the mixing channel B-1300 can be configured to provide active perturbations instead of the geometrical perturbations B-1500 in order to mix the plurality of additive substances A-1200 and the base substance A-1100 together, as illustrated in FIG. 2B. As for the plurality of geometrical perturbations B-15000 in the passive configuration, the active geometrical perturbations can generate successive motions of stretching and folding of the interface I between the plurality of additive substances A-1200 and the base substance A-1100. The plurality of active perturbations can correspond to unsteady, e.g. pulsing and/or oscillating, inlet flows that generate a time variation on the flow of the plurality of additive substances A-1200 and the base substance A-1100. For example, the mixing assembly B-1000 can include a first pulsing pump B-2510 fluidly connected to the additive inlet B-1100, a second pulsing pump fluidly B-2520 connected to the base inlet B-1200, and a cavity B-2300 placed between the additive inlet B-1100, the base inlet B-1200, and the outlet B-1400.

The first and second pulsing pumps B-2510, B-2520 can flow back and forth the plurality of additive substances A-1200 and the base substance A-1100 into the cavity B-2300 to mix the plurality of additive substances A-1200 and the base substance A-1100 together. In addition, the first pulsing pump B-2510 can flow the plurality of additive substances A-1200 back and forth from the cavity B-2300 at predetermined pulsing additive parameters, e.g. an additive pulsing frequency and a pulsing additive amplitude, and the second pulsing pump B-2520 can flow the base substance A-1100 back and forth from the cavity B-2300 at predetermined pulsing base parameters, e.g. a substance pulsing frequency and a substance pulsing amplitude, wherein the predetermined pulsing additive parameters and the predetermined pulsing substance parameters are determined to maximize the mixing between the plurality of additive substance A-1200 and the base substance A-1100.

The outlet B-1400 can be a cosmetic applicator or be fluidly connected to a cosmetic applicator such as a brush, a lip brush, or a doefoot applicator.

Alternatively, the mixing channel B-1300 can be replaced by a container that receives the plurality of additive substances A-1200 and the base substance A-1100 and wherein mixing between the plurality of additive substances A-1200 and the base substance A-1100 is manually performed by a user.

Figure 3:
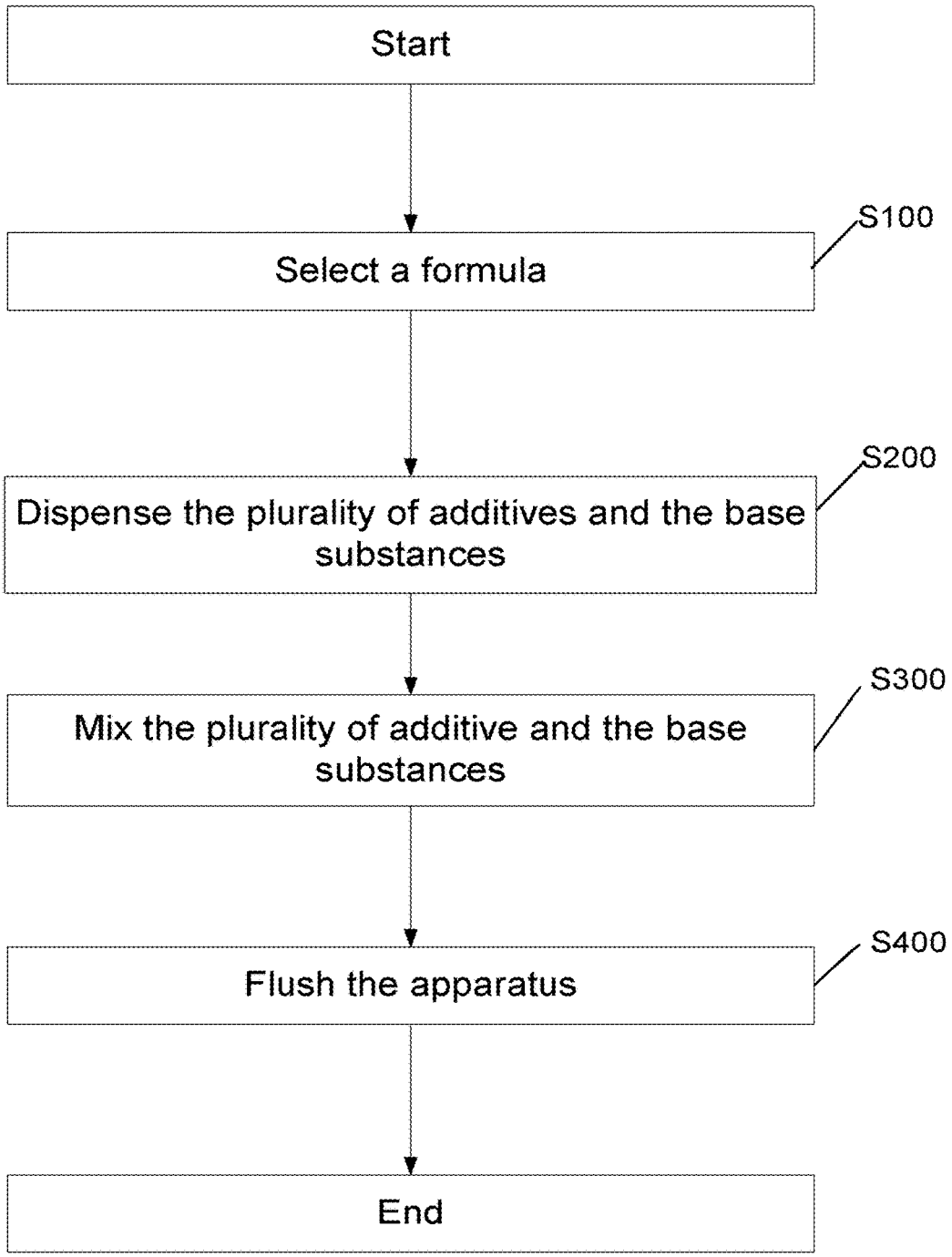
FIG. 3 is a flow chart of a method for operating the apparatus to realize personalized cosmetic compositions, according to certain aspects of the disclosure.

FIG. 3 is a flow chart of a method for operating the apparatus 1000 to realize the personalized cosmetic compositions 1100, according to certain aspects of the disclosure.

In a step S100, the plurality of selected additive quantities Qa is selected. The plurality of selected additive quantities Qa may be chosen as a function of personal preferences of the consumer 100, e.g. color/tone, finish, sheen, and/or texture. For example, a first quantity of the cyan binder A-1202C, a second quantity of the magenta binder A-1202M, a third quantity of the yellow binder A-1202Y, and a fourth quantity of the black binder A-1202B may be selected to provide a color desired by the consumer 100. This selection may be performed manually by the consumer 100, automatically or the combination of both via software instruction performed by the circuitry 3000 and/or the electronic personal device 110, e.g. a computer, a laptop, a smartphone, a tablet, or the like, of the consumer 100.

For example, the consumer 100 can select a color defined by a red component, a green component, and a blue component, via graphical consumer interface software instructions executed on the electronic control unit D-1000 and/or the electronic device 110 of the consumer 100 and the selected color can be converted into a quantity of cyan, a quantity of magenta, a quantity of yellow, and a quantity of black.

In another example, images of the lips and/or skin of the consumer 100 may be captured by a camera of the electronic control unit D-1000 and/or the electronic device 110. Based on these images a red component, a green component, and a blue component of the lips and/or skin color can be extracted and compared to a plurality of coordinate colors associated with a quantity of cyan, a quantity of magenta, a quantity of yellow, and a quantity of black to coordinate with the lip color and/or the skin color of the consumer 100. The coordinate colors may be stored in database D-2500 of the electronic control unit D-1000.

In a step S200, the formula supply assembly A-1000 can be operated to dispense the plurality of selected additive quantities Qa and the predetermined base quantity Qb to the mixing assembly.

For example, the electronic control unit D-1000 can send a plurality of additive actuation signals SAa to the plurality of additive pumps A-1230, and base actuation signals to the base pump A-1130, wherein the plurality of additive actuation signals SAa is commensurate with the plurality of selected additive quantities Qa and the base actuation signals are commensurate with the predetermined base quantity Qb.

In a step S300, the plurality of additive substances A-1200 and the base substance A-1100 are mixed together to provide the predetermined composition dose Qc with the desired formulation.

For example, the electronic control unit D-1000 can send pushing actuation signals to the plurality of additives pumps A-1230, the base pump A-1130, and/or the flush pump A-1330 to push the plurality of selected additive quantities Q and the predetermined base quantity Qb through the mixing channel B-1300 to mix the plurality of additive substances A-1200 and the base substance A-1100 together in order to obtain the personalized cosmetic compositions 1100 with substantially homogeneous characteristics, e.g. uniform color, texture, and/or finish.

In a step S400, the apparatus 1000 is flushed.

For example, the electronic control unit can send flush actuation signals SAf commensurate with a flush quantity Qf to the flush pump A-1330 to clean the apparatus 1000 to remove any residue left by the plurality of additive substances A-1200 and/or the base substance A-1100.

Figure 4:
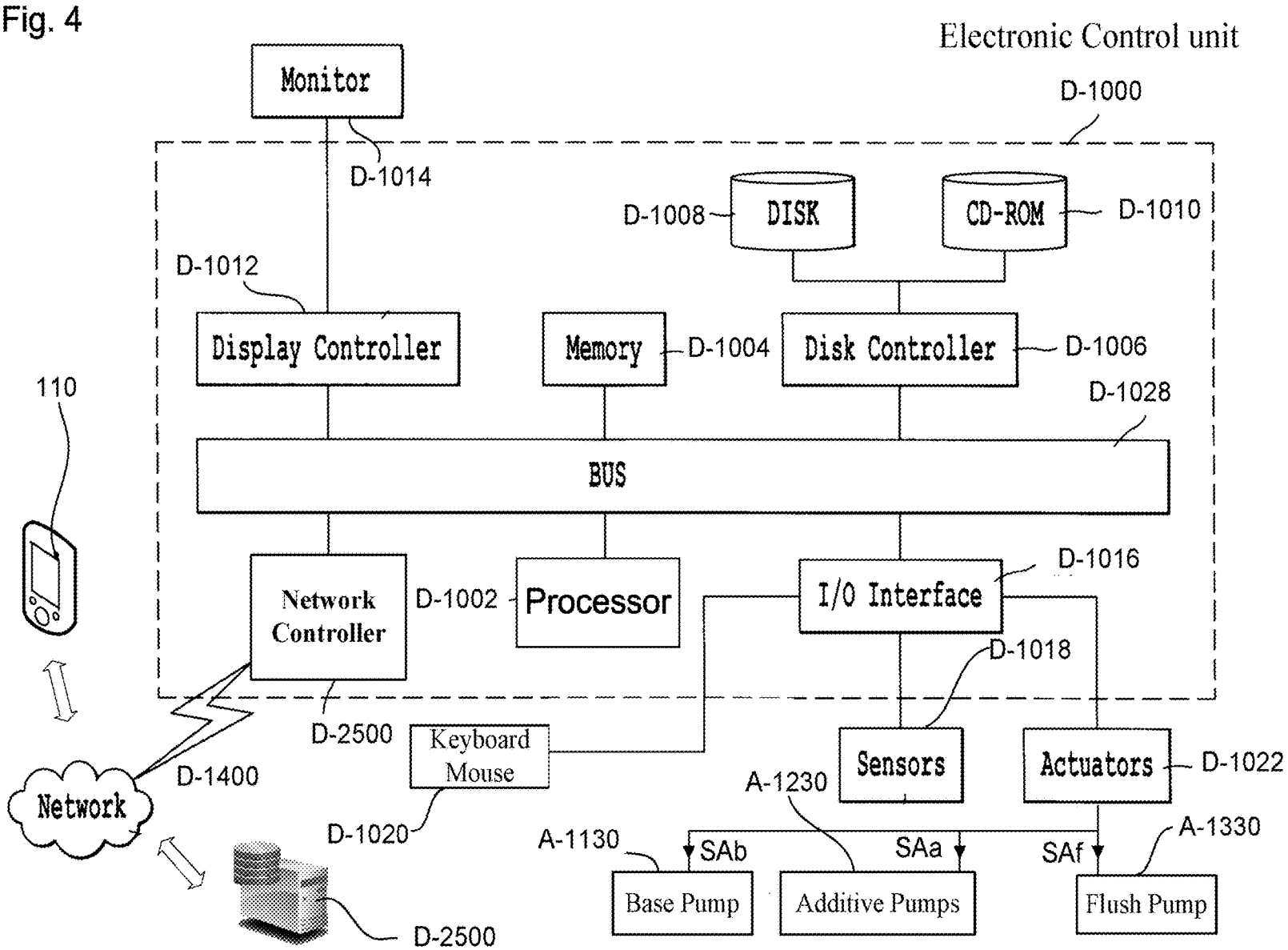
FIG. 4 is a schematic view of a hardware diagram of an electronic control unit of the apparatus to realize personalized cosmetic compositions, according to certain aspects of the disclosure.

FIG. 4 depicts the electronic control unit D-1000. As shown in FIG. 4, systems, operations, and processes in accordance with this disclosure may be implemented using a processor D-1002 or at least one application specific processor (ASP). The processor D-1002 may utilize a computer readable storage medium, such as a memory D-1004 (e.g., ROM, EPROM, EEPROM, flash memory, static memory, DRAM, SDRAM, and their equivalents), configured to control the processor D-1002 to perform and/or control the systems, operations, and processes of this disclosure. Other storage mediums may be controlled via a disk controller D-1006, which may control a hard disk drive D-1008 or optical disk drive D-1010.

The processor D-1002 or aspects thereof, in an alternate embodiment, can include or exclusively include a logic device for augmenting or fully implementing this disclosure. Such a logic device includes, but is not limited to, an application-specific integrated circuit (ASIC), a field programmable gate array (FPGA), a generic-array of logic (GAL), and their equivalents. The processor D-1002 may be a separate device or a single processing mechanism. Further, this disclosure may benefit form parallel processing capabilities of a multi-cored processor.

In another aspect, results of processing in accordance with this disclosure may be displayed via a display controller D-1012 to a monitor D-1014 that may be peripheral to or part of the electronic control unit D-1000. Moreover, the monitor D-1014 may be provided with a touch-sensitive interface to a command/instruction interface. The display controller D-1012 may also include at least one graphic processing unit for improved computational efficiency. Additionally, the electronic control unit D-1000 may include an I/O (input/output) interface D-1016, provided for inputting sensor data from sensors D-1018 and for outputting orders to actuators D-1022. The sensors D-1018 and actuators D-1022 are illustrative of any of the sensors and actuators described in this disclosure. For example, the actuators D-1022 can be the plurality of additives pumps A-1230, the base pump A-1130, and/or the flush pump A-1330.

Further, other input devices may be connected to an I/O interface D-1016 as peripherals or as part of the electronic control unit D-1000. For example, a keyboard or a pointing device such as a mouse D-1020 may control parameters of the various processes and algorithms of this disclosure, and may be connected to the I/O interface D-1016 to provide additional functionality and configuration options, or to control display characteristics. Actuators D-1022 which may be embodied in any of the elements of the apparatuses described in this disclosure may also be connected to the I/O interface D-1016.

The above-noted hardware components may be coupled to the network D-1400, such as the Internet or a local intranet, via the network controller D-2500 for the transmission or reception of data, including controllable parameters to a mobile device. A central BUS D-1028 may be provided to connect the above-noted hardware components together, and to provide at least one path for digital communication there between.

The foregoing discussion discloses and describes merely exemplary embodiments of an object of the present disclosure. As will be understood by those skilled in the art, an object of the present disclosure may be embodied in other specific forms without departing from the spirit or essential characteristics thereof. Accordingly, the present disclosure is intended to be illustrative, but not limiting of the scope of an object of the present disclosure as well as the claims.

Numerous modifications and variations on the present disclosure are possible in light of the above teachings. It is therefore to be understood that within the scope of the appended claims, the disclosure may be practiced otherwise than as specifically described herein.

What is claimed is:

1. An apparatus to realize personalized cosmetic compositions comprising: a formula supply assembly including:
- a plurality of additive reservoirs that contains a plurality of additive substances,
- a plurality of additive pumps that supplies selected additive quantities of the plurality of additive substances,
- a flush reservoir that contains a flush substance, and
- a flush pump that supplies a flush quantity of the flush substance;
- a mixing assembly including:
- an additive inlet that receives the selected additive quantities and the flush quantity,
- an outlet that delivers the personalized cosmetic compositions, and
- a mixing channel that channels the selected additive quantities from the additive inlet to the outlet; and
- an electronic control unit configured to
- acquire a desired formulation from a consumer,
- determine the selected additive quantities based on the desired formulation,
- operate the plurality of additive pumps to provide the selected additive quantities to the additive inlet, and
- operate the flush pump to push the selected additive quantities along the mixing channel to provide mixing between the additive quantities and form the personalized cosmetic compositions,
- wherein the mixing channel includes a cavity positioned between the outlet and the additive inlet and a pulsing pump connected to the additive inlet and the cavity that mixes the plurality of additives through successive motions of stretching and folding.

2. The apparatus of claim 1, wherein each reservoir of the plurality of additive reservoirs is removable and replaceable.

3. The apparatus of claim 1, wherein the formula supply assembly includes a manifold connected to the plurality of additive reservoirs and the flush reservoir.

4. The apparatus of claim 1, wherein the electronic control unit is further configured to acquire the desired formulation from an electronic device of the consumer.

5. The apparatus of claim 1, wherein the plurality of additive substances includes a plurality of colored lipsticks to produce the personalized cosmetic compositions in a color selected by the consumer.

6. The apparatus of claim 5, wherein the plurality of colored lipsticks includes a red lipstick, a pink lipstick, a beige lipstick, and a white lipstick.

7. An apparatus to realize personalized cosmetic compositions comprising:
- a formula supply assembly including:
- a plurality of additive reservoirs that contains a plurality of additive substances,
- a plurality of additive pumps that supplies selected additive quantities of the plurality of additive substances,
- a base reservoir that contains a base substance, and
- a base pump that supplies a base quantity of the base substance;

a mixing assembly including:

an additive inlet that receives the selected additive quantities, a base inlet that receives the base quantity, an outlet that delivers the personalized cosmetic compositions, and a mixing channel that channels the selected additive quantities and the base quantity from the additive inlet and the base inlet to the outlet; and an electronic control unit configured to acquire a desired formulation from a consumer, determine the selected additive quantities based on the desired formulation, and operate the plurality of additive pumps and the base pump to push the selected additive quantities and the base quantity along the mixing channel to provide mixing between the additive quantities and the base quantity to form the personalized cosmetic compositions, wherein the mixing channel includes a cavity positioned between the outlet and the additive inlet and a pulsing pump connected to the additive inlet and the cavity that mixes the plurality of additives through successive motions of stretching and folding.

8. The apparatus of claim 7 wherein each reservoir of the plurality of additive reservoirs is removable and replaceable.

9. The apparatus of claim 7, wherein the formula supply assembly includes a manifold connected to the plurality of additive reservoirs.

10. The apparatus of claim 7, wherein the electronic control unit is further configured to acquire the desired formulation from an electronic device of the consumer.

11. The apparatus of claim 7, wherein the plurality of additive substances includes a plurality of pigments to produce the personalized cosmetic compositions in a color selected by the consumer.

12. The apparatus of claim 11, wherein the plurality of pigments includes a cyan pigment, a magenta pigment, a yellow pigment, and a black pigment.

* * * * *